United States Patent [19]

Briscoe

[11] Patent Number: 4,615,386

[45] Date of Patent: Oct. 7, 1986

[54] LINEAR FORCE CENTRALIZER

[75] Inventor: William E. Briscoe, Houston, Tex.

[73] Assignee: Halliburton Company, Duncan, Okla.

[21] Appl. No.: 704,690

[22] Filed: Feb. 22, 1985

[51] Int. Cl.[4] ..... E21B 17/10

[52] U.S. Cl. ..... 166/241

[58] Field of Search ..... 166/241, 172, 173, 174; 175/73; 308/4 A

[56] References Cited

U.S. PATENT DOCUMENTS

| | | | |
|---|---|---|---|
| 1,898,074 | 2/1933 | Bailey | 308/6 A |
| 2,867,280 | 1/1959 | De Jarnett | 166/173 |
| 2,899,633 | 8/1959 | Smith et al. | 166/241 X |
| 3,915,229 | 10/1975 | Nicolas | 166/241 |
| 4,243,099 | 1/1981 | Rodgers, Jr. | 166/241 X |
| 4,557,327 | 12/1985 | Kinley et al. | 166/241 |

*Primary Examiner*—James A. Leppink
*Assistant Examiner*—Matthew Smith
*Attorney, Agent, or Firm*—William J. Beard

[57] ABSTRACT

A linear force centralizer adapted to be supported on a downhole tool is set forth. In the preferred and illustrated embodiment, the centralizer includes multiple sets of long and short arms extending outwardly to define a protruding knuckle, the knuckle having a roller adapted to be contacted against the surrounding well borehole. The arms are connected to similar, spaced apart, facing crosshead assemblies slideable on a central mandrel. The crosshead assemblies cooperate with first and second spring means. The first spring means increases in resilient force acting on the arm as the arm is deflected radially inwardly. The second spring means forms a resilient force which increases as the arm is deflected radially outwardly. The sum of the two spring forces is approximately constant through a range of deflection of the arms, thereby providing a relatively constant force.

9 Claims, 3 Drawing Figures

LINEAR FORCE CENTRALIZER

BACKGROUND OF THE DISCLOSURE

This disclosure is directed to a centralizing apparatus adapted to be attached or affixed to a supported downhole tool. The precise nature and definition of the downhole tool is not particularly important, and may be by means of example and not limitation, an acoustic bond logging apparatus. Other types of downhole tools may be set forth, and they are generally described as including an elongate cylindrical housing which functions either as a central mandrel or which includes a central mandrel enabling it to be connected with a mandrel through the centralizer of this disclosure. They are connected serially to thereby define a mandrel supported centralizer biased by spring mechanisms to be described so that the bias force is approximately uniform over a range of deflection of the centralizer arms.

A centralizer is a device which is adapted to be connected serially with a downhole tool. Typically, a downhole tool is run in a well bore supported on a wireline. The centralizer is included to position the downhole tool at a central location in the axis of the well borehole. This is desirable ordinarily to prevent snagging the tool and to enable the procedure conducted by the downhole tool to be carried out in ordinary course. Moreover, such a centralizer tends to deflect, thereby repositioning itself and the attached tool so that they are near the centerline than would be the case without a centralizer. While in theory, the well borehole is round, in practice, there is a tendency for the downhole tool to decentralize, meaning that it is positioned against one side of the well borehole. This interfers with its operation, and creates problems in that the procedure conducted by the tool may be less than perfectly performed; even worse, decentralization is difficult to measure because of the randomness of such occurrences. This apparatus is a linear force centralizer which aids and assists in maintaining a supported tool in a more or less centralized position. In typical circumstances, duplicate sets of this equipment are installed with a downhole tool to aid and assist in positioning various portions of the tool body supported thereby central of the well borehole.

The linear force centralizer of this disclosure particularly features a linear resistent force acting on the extended arms. It includes preferably opposing pairs of arms. In fact, each arm is made up of first and second arm segments which are dissimilar in length. One is longer than the other and they join at a knuckle joint having a outwardly protruding roller to permit contact against the well borehole without frictional dragging wherein the roller protects the joined long and short arms. The arm segments are themselves connected to spaced crosshead assemblies. The crosshead assemblies support several such arms as for instance, four arm segments on each crosshead assembly to thereby define four pair of arms; opposite arms are symmetrical to one another while the remaining opposite pairs are also symmetrical; however, they are arranged to that their long arm segments are connected to the common crosshead with the short arm segments of the other pair. In other words, the four sets of arms that protrude radially outwardly are staggered with regard to their outwardly disposed contact means.

This staggered arrangement in conjunction with the equal force resilient spring means to be described below enables the system to form a restoring force. The equal force system refers to a set of springs which are arranged so that the arms are under approximate constant force with deflection. As they deflect through a specified angular range, the forces acting on the arms are approximately equal and hence balanced. This enables the arms to deflect through a relatively wide range without having a biased force. This assists in accommodating variations in borehole geometry. It also assists in providing a relatively constant centering force acting on the decentralized equipment when that occasion arises.

While the foregoing is generally descriptive of the background of the present disclosure and reveals few details of the present apparatus, the scope is set forth in greater detail hereinafter with the description of the preferred embodiment in conjunction with the below included drawings.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
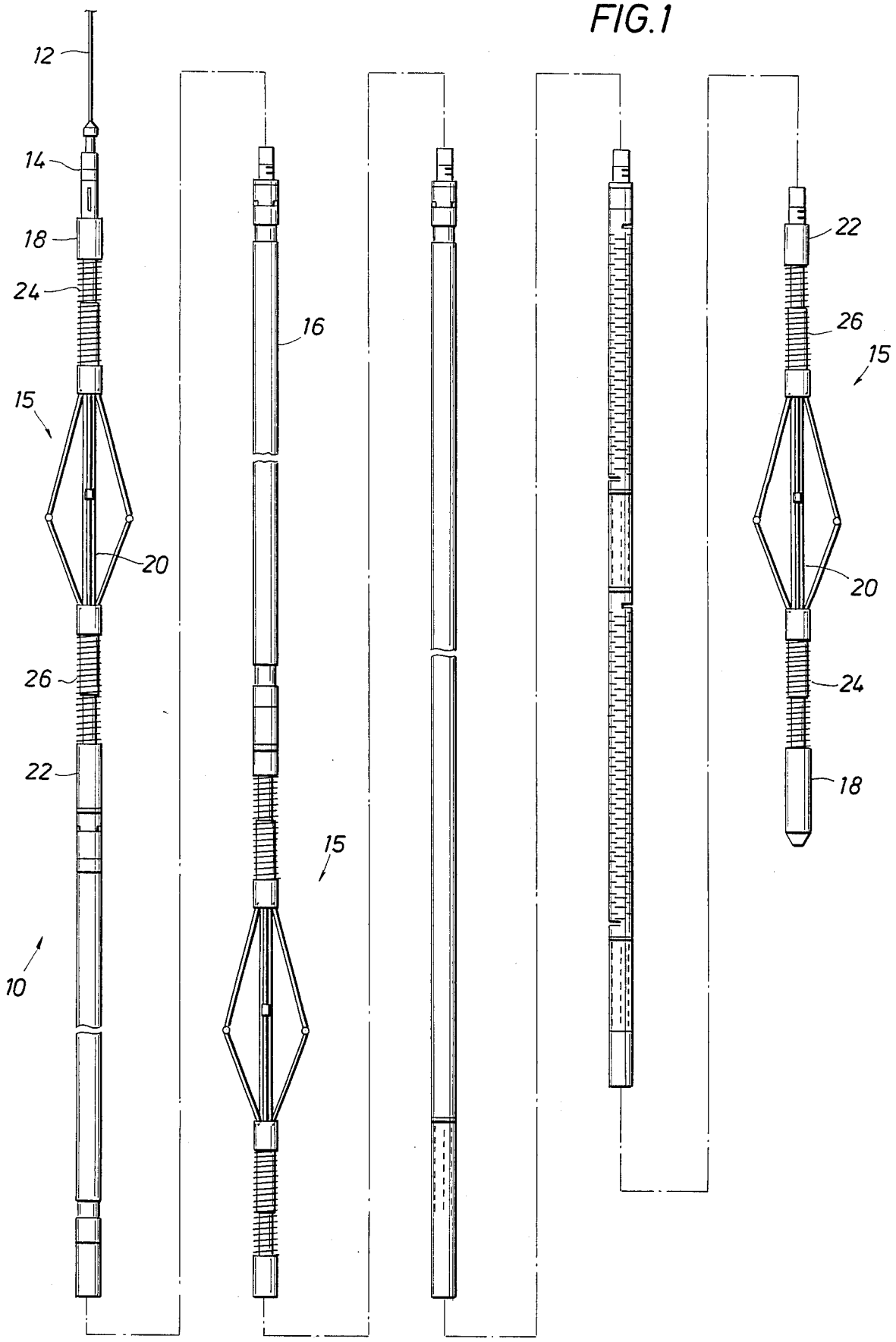
FIG. 1 shows the linear force centralizer of the present disclosure installed in conjunction with a downhole tool and adapted to be run in a cased or open hole on a wireline wherein the present centralizer positions the supported downhole tool.

Attention is first directed to FIG. 1 of the drawings where a series of devices are indicated generally at 10 and which devices are assembled with the linear force centralizer of the present disclosure. This comprises a set of devices which are typically lowered in a well bore on a wireline 12. The wireline joins to a fishing neck 14. The fishing neck is threadably connected with the centralizer identified generally by the numeral 15 that is taught by the present disclosure. The centralizer 15 in turn supports a downhole tool 16. The tool 16 may have any substantial length and is typically centralized by the centralizer 15 which is shown above the tool 16, and a second centralizer 15 below the tool 16. This can be extended to include more than two centralizers to support one or more downhole tools 16. In general terms, the nature and specific function accomplished by the downhole tool is typically one which requires that the tool 16 be centralized in its operation. The centralizer of this disclosure incorporates an end plug 18 and a central mandrel 20. The mandrel 20 extends from the end plug 18 to a similar end plug 22 at the opposite end. The end plugs are enlarged collars at the ends of the mandrel 20 and extend radially outwardly to support the illustrated coil springs 24 at the upper end and 26 at the lower end. The coil springs 24 and 26 bear against crossheads as will be described on reference to FIGS. 2 and 3. The mandrel 20 is of substantial length, typically in the range of three to five feet in length. Moreover, the coil springs 24 and 26 are several inches in length and are received on the exterior of the mandrel and are springs placed under compression by the crosshead assemblies bearing against them. The springs 24 and 26 tend to centralize the arm structure which is shown in greater detail in FIGS. 2 and 3 and aid and assist in providing a fairly linear force acting on the system.

Figure 2:
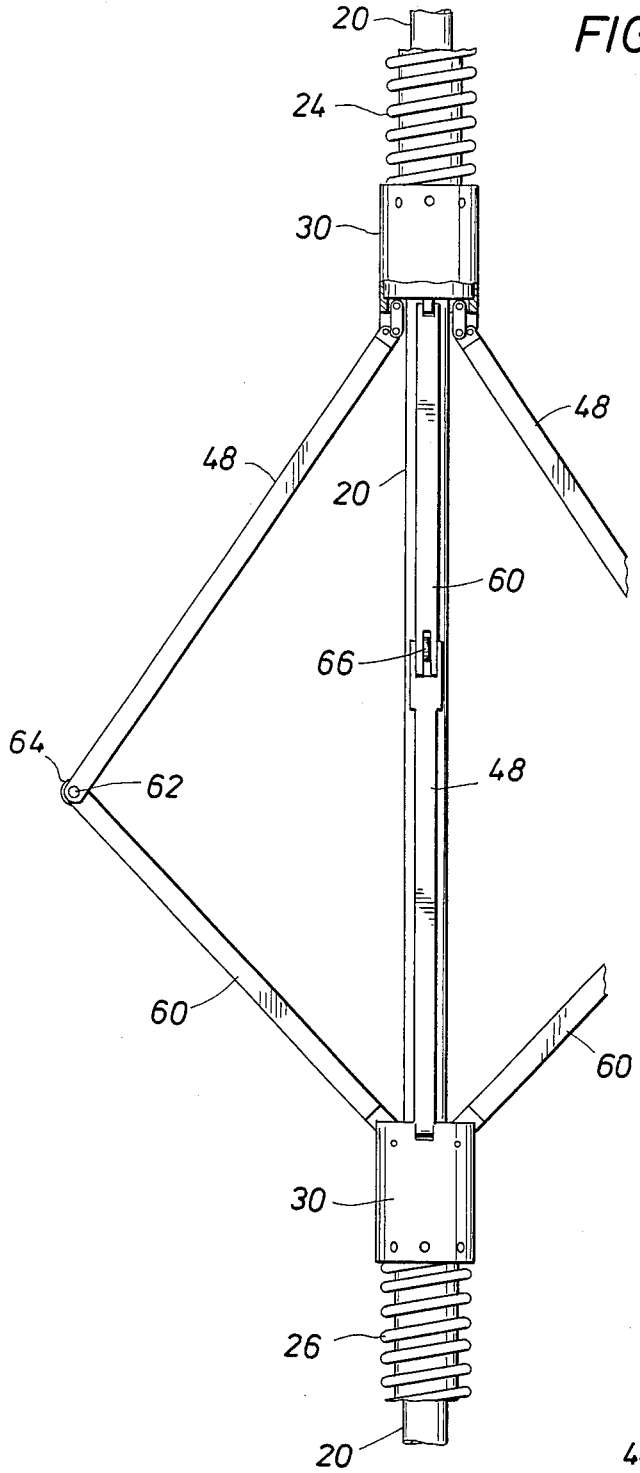
FIG. 2 is an enlarged view of the deployed two arm system of the present apparatus further showing mounting crossheads for said arms.

Attention is next directed to FIG. 2 of the drawings. There, the coil spring 24 is shown about the mandrel 20. The mandrel 20 extends the full length of FIG. 2 except that the central portions thereof are omitted for sake of clarity to show details of the arm construction. Further, the lower portion of FIG. 2 shows the coil spring 26 which is bearing upwardly against the crosshead assembly to be described.

The topmost crosshead assembly is identified by the numeral 30. It is preferably identical to the bottom crosshead assembly identified by the same numeral. They differ only in location, and the two are spaced from one another, both being telescoped on the exterior of the mandrel 20. That is, they are received on the mandrel for sliding movement. The sliding movement occurs upon deflection of the arms as will be described. Such movement may require the two crossheads to move closer together or further apart. In the latter event, the springs 24 and 26 are somewhat compressed if this occurs.

Figure 3:
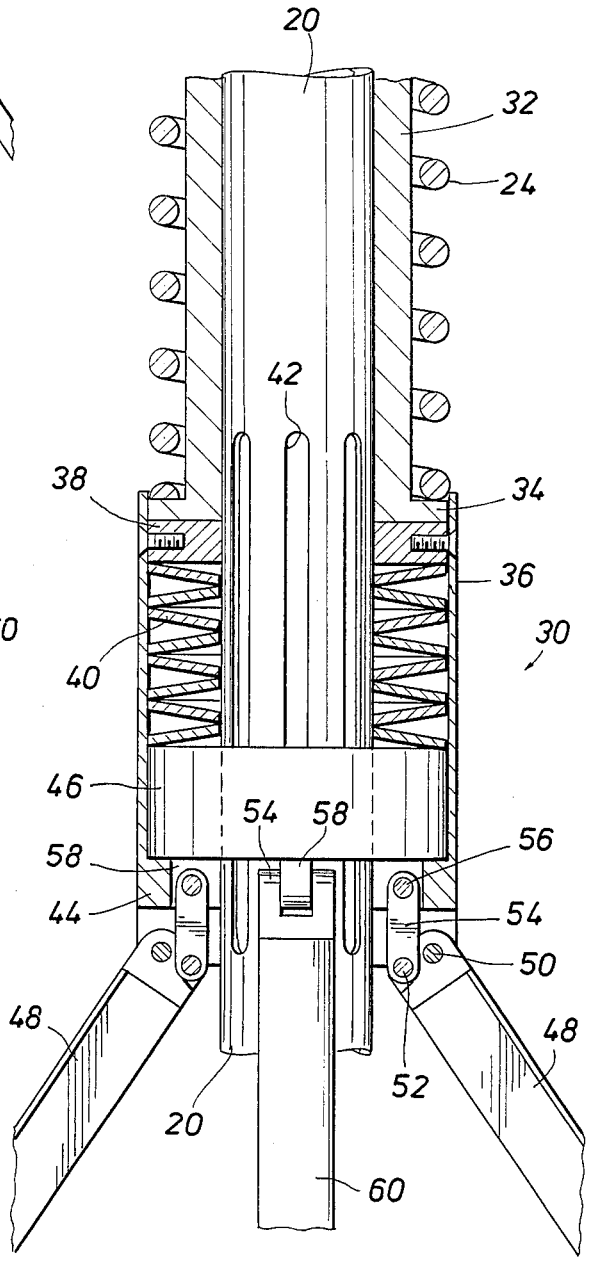
FIG. 3 is a sectional view through the crosshead assembly on the mandrel which supports the crosshead assembly showing additional details of construction.

The crosshead assembly 30 is better shown in FIG. 3. There, the upper crosshead assembly has been disclosed to the degree that internal details of construction are revealed. This internal construction is duplicated with the lower crosshead assembly. The mandrel 20 again is shown in the upper view. A spring collar 32 is located at the upper end of the crosshead assembly and has a protruding shoulder 34 which supports the coil spring 24. The collar 32 slides on the exterior of the mandrel. It is forced downwardly and received inside a crosshead shell or housing 36. The shell or housing is closed at the upper end by means of an internal ring 38, the ring being joined to the shell by means of suitable bolts. The ring closes off the interior cavity of the shell 36. That cavity defines an annular hollow space to receive a stack of Bellville springs or washers 40. They are stacked so as to define a resilient spring member. They fit within the shell and have an internal I.D. which enables them to smoothly surround the mandrel 20. The mandrel 20 is slotted at a number of locations at 42. These slots together with protruding screw heads installed in the crosshead limit the sliding motion of the crosshead on the mandrel.

The shell 36 has an internal protruding shoulder 44 which receives a floating lock ring 46. The ring 46 cannot move downwardly because it is held in location by the protruding shoulder 44. On the other hand, it cannot move upwardly except that it creates a force acting thereagainst from the stack of Bellville washers. Limited upward movement occurs with an increasing resilient force applied by the spring system defined by the Bellville washers 40.

As described at this juncture, the Bellville washers constitute a single spring system. Separately, the compressed coil spring 24 defines a second spring means, the two bearing on the crosshead assembly wherein the two sets of forces impact operation of the arms as will be described. Continuing with FIG. 3, the numeral 48 identifies a protruding arm which extends radially outwardly. The arm terminates at a supporting mounting pin 50 which is held by a clevis affixed to the shoulder 44. That is, the pin 50 is held fixed in location relative to the shoulder 44. A pin 52 is a parallel pin connected to the arm. The pin 52 connects between the arm and an elongate double link 54. The link 54 extends from the pin 52 to connect with the ring 46. It connects by means of a connective pin 56 held by an upstanding clevis 58. This converts rotative movement of the arm 48 into linear movement of the member 46 to compress the springs 40. It will be observed that the arm rotates, transferring the motion to the connective link 54 and then ultimately into the stack of Bellville washers.

Symmetry is achieved by providing such a connection on opposite sides of the mandrel 20. This symmetry is accomplished by arranging the opposite arm with a similar connective link. This is found with two arms arranged 180° of one another relative to the mandrel. There is another pair of arms shown in FIG. 3 and again, the clevis 58 is shown to support the connective link 54 (actually, duplicated on opposite sides of the clevis) for the purpose of deflecting a different length arm 60. The arm 60 is similar in construction to the arm 48 but it differs in length. Returning now to FIG. 2, there it will be observed that the arm 60 is connected in like fashion to the arm 48. The arm 48 will be described simply as a long arm and it pivotly connects with a short arm 60 at its outward end. Thus, the arm 60 connects with the arm 48 but the sequence, moving from the top to the bottom of the centralizer is different for different arm pairs.

An important factor to note is that the arms 48 and 60 join at a pin connection 62. The pin also supports a roller 64. The roller 64 is carried by both arms and serves as a contact means to ride against the wall of the borehole. It is forced radially inwardly by the wall and is moved outwardly by spring forces which are relatively uniform. This arrangement deflects the arms 48 and 60 acting in conjunction with one another. As they are flattened in FIG. 2, the crossheads 30 will be pushed apart. If the arms deflect at a greater angle, the crossheads are permitted to come closer together.

There are two pair of arms arranged with the contact means 64 at the illustrated elevation shown in FIG. 2. There are another two pair arranged with second rollers 66 at a different elevation. Thus, the two arms shown in side view in FIG. 2 define points of contact at a specified elevation while the roller 66 (duplicated by a second such roller opposite the one illustrated) define points of contact at a separate elevation.

The two pair of arms having the rollers 64 define a set of contact points cooperative with the borehole. The rollers 66 (there being two) define an alternative elevation at which contact is also made. This type of arrangement enables four arms to be deployed in the centralizer shown in FIG. 2. Assume that the device is located where it is not central of a well borehole and thus, one of the rollers 64 or 66 is brought in contact with the surrounding borehole. As will be understood, it will be forced toward the mandrel 20. When this occurs, the arm segments 48 and 60 are depressed toward mandrel and rotate to flatten. Such rotation is accompanied by a transfer of axial loading to the Bellville washers better shown in FIG. 3. This is accomplished through the links 54. As rotation occurs, the Bellville washers create a resilient resistive force which increases with rotation. This defines a first force. There is, however, a second force to be considered. The crossheads 30 will slide somewhat on the mandrel. The maximum range is accomplished if the arms were completely flattened against the mandrel whereupon the crossheads would be forced apart by the maximum distance. As the arms are flattened, the crossheads move apart and are impacted by the resistent force of the compressive springs 24 and 26. This spring system forms a second force. This force is varied oppositely of the force created by the Bellville washers. That is, with arm deflection (meaning a change in radial angle of the arms relative to the mandrel 20) the second resilient force varies in the opposite fashion from the first resilient force. The two forces are additive to the arm segments, being duplicated top and bottom. Thus, for a specified range of deflection (referring to radial movement of the rollers 64 and 66 toward the mandrel), there is an approximately fixed force acting on the arms. This keeps the arm system from flopping to a specified angle and sustaining that angle. It enables the rollers 64 and 66 to deflect more readily (without bias) and thereby changes the radial extent of the arms in response to deflection by the surrounding borehole. Even if only one of the rollers is contacted against the borehole, the other arms cooperatively collapse simultaneously. That is, all four arm pairs deflect inwardly or outwardly as a unit. It will also be observed that in the preferred embodiment, the arms 48 and 60 are inverted relative to one another from pair to pair. This provides a degree of symmetry at the two crossheads. Thus, the summation of axial loading forces on a crosshead is duplicated at the opposite crosshead.

Utilizing this arrangement, and preferably in duplicate sets of centralizers, the downhole tool 16 shown in FIG. 1 can be manipulated on a wireline and is restored automatically by the centralizers of this disclosure to a central axial position within the surrounding borehole. This kind of arrangement enables the downhole tool 16 to be operated as intended. Recall that decentralization may jeopardize operation of the tool 16.

The foregoing is directed to a centralizer featuring an approximately linear force over a range of deflection. This centralizer enables deployed arm pairs to restore the central mandrel and hence anything connected thereto to a central axial position.

While foregoing is directed to the preferred embodiment, the scope is determined by the claims which follow.

What is claimed is:

1. For use with a downhole tool having a mandrel enabling connection, centralizing apparatus which comprises:

(a) at least four sets of radially outwardly extending arms, each set comprising:

(1) a radially outwardly extending first arm segment having an outer end;

(2) a second arm segment connected to the outer end of said first segment;

(3) said two arm segments supporting well borehole contact means for contacting the wall thereof and wherein said contact means deflects said arm segments dependent on the location of the downhole tool relative to the well borehole;

(4) said first and third arms being spaced 180° apart about the circumference of said mandrel and said second and fourth arms being spaced apart 180° about the circumference of said mandrel said four arms being spaced 90° from each other;

(5) said first and third arms having long first arm segments and said second and fourth arms having short first arm segments and each of said four arms supporting said contact means at the end of said first arm segments thereby positioning two of said contact means at one centralizer elevation and the remaining two of said contact means at a different centralizer elevation;

(b) collar means connected to said first arm segments and enabled to move at urging of said arms;

(c) an elongate mandrel slidably mounting said collar means for movement thereon, said collar means moving to alter the radial angle of said first segments;

(d) second collar means connected to said second arm segments and mounted on said mandrel, said second collar means enabling said second arm segments to alter the radial angle of said second arm segments;

(e) resilient means acting cooperatively on both of said first and second collar means, said resilient means creating a biasing force on said arms causing said arms to extend outwardly and wherein said arms are contacted at said contact means against the well borehole;

(f) said arms collectively moving against said resilient means to urge said mandrel toward the centerline of the well borehole; and (g) wherein said mandrel includes end located means adapted to be connected to a downhole tool for centralization.

2. The apparatus of claim 1 wherein said resilient means includes:

(a) first spring means increasing in resilient force acting on said arms with increasing radial angle thereof;

(b) second spring means increasing in resilient force acting on said arms with changing radial angle thereof; and (c) whereinsaid first and second spring means add forces to provide an approximately fixed force on said arms over a range of radial angles.

3. The apparatus of claim 1 wherein said first and second collar means each comprise:

(a) a surrounding cylindrical shell positioned about said mandrel;

(b) a lower internal lip on said shell protruding radially inwardly;

(c) a floating lock ring adjacent to said lip and captured within said shell;

(d) a compressed spring within said shell bearing against said floating lock ring wherein said spring comprises a first spring means;

(e) pivot connection means on said shell adapted to connect pivotally to said arms;

(f) connective links connecting between said arms and said lock ring, said links conveying motion of rotation of said arms to said lock ring for movement of said thrust rings in response to motion;

(g) an end closure plate within said shell closing said shell and concentric around said mandrel, said end closure plate including a face for supporting said spring means within said shell; and (h) an external thrust shoulder on said shell for receiving the force of a second spring means bearing against said shell; said second spring means forming a force acting along said mandrel.

4. The apparatus of claim 1 wherein said first and second arm segments are pin connected, and said pin supports a protruding roller comprising said contact means.

5. The apparatus of claim 1 wherein said first and second collar means ride over slots in said mandrel and movement is limited by slot engaging means.

6. The apparatus of claim 5 including bolt heads in said slots.

7. The apparatus of claim 1 wherein said arm segments are pivotally mounted on a first pin and connected by a second pin parallel to said first pin to couple axial movement along said mandrel by link means connected to said second pin.

8. The apparatus of claim 7 including clevis means connected between said link means and said collar means.

9. The apparatus of claim 8 including a floating lock ring connected to said link means for altering a spring force on said collar means.

* * * * *